US005992564A

United States Patent [19]

Kirkpatrick et al.

[11] Patent Number: 5,992,564

[45] Date of Patent: Nov. 30, 1999

[54] LADDER GUIDE ASSEMBLY FOR A SCAFFOLDING

[76] Inventors: Bradley J. Kirkpatrick, 427 E. Park Ave.; Burt Schwab, 1025 Petersen, both of Aurora, Ill. 60505

[21] Appl. No.: 09/198,920

[22] Filed: Nov. 24, 1998

[51] Int. Cl.[6] ..... E06C 7/16

[52] U.S. Cl. ..... 182/117; 182/122

[58] Field of Search ..... 182/117, 118, 182/120–122, 107, 214

[56] References Cited

U.S. PATENT DOCUMENTS

| | | | |
|---|---|---|---|
| 1,393,922 | 10/1921 | Taylor | 182/214 |
| 1,478,823 | 12/1923 | Gauss | 182/214 |
| 2,307,543 | 1/1943 | Reed | 182/120 |
| 3,870,124 | 3/1975 | Howard . | |
| 4,067,412 | 1/1978 | Jackson . | |
| 4,086,979 | 5/1978 | Dunn . | |
| 4,469,195 | 9/1984 | Sartain . | |
| 4,483,416 | 11/1984 | Garcia . | |
| 4,754,843 | 7/1988 | Anderson . | |
| 4,924,971 | 5/1990 | Rice . | |
| 4,949,810 | 8/1990 | Dwinnell . | |
| 5,054,581 | 10/1991 | Henson . | |
| 5,255,758 | 10/1993 | Hood . | |
| 5,429,205 | 7/1995 | Collins | 182/122 |
| 5,484,036 | 1/1996 | Cothern . | |
| 5,775,465 | 7/1998 | Vossler | 182/214 |

FOREIGN PATENT DOCUMENTS

| | | | |
|---|---|---|---|
| 1122962 | 9/1956 | France | 182/214 |

*Primary Examiner*—Alvin Chin-Shue
*Attorney, Agent, or Firm*—Meroni & Meroni

[57] ABSTRACT

A ladder support device is secured to a scaffold by two base arms. At one end of the base arms the device forms a "channel" in which the ladder can move vertically but not horizontally. This secures the ladder so that it cannot fall away from the scaffold or to either side. In addition, it allows the scaffold to be raised or lowered without having to detach the ladder from the scaffold.

13 Claims, 3 Drawing Sheets

LADDER GUIDE ASSEMBLY FOR A SCAFFOLDING

BACKGROUND OF THE INVENTION

The invention relates generally to ladder and scaffolding structures and devices. More particularly, the invention pertains to a ladder support device that will support a ladder against a scaffold and allow the scaffold to be safely moved up and down as required without having to detach the ladder.

There are many ladder support devices known in the prior art. The prior art includes a scaffold ladder structure where the ladder is a built in part of the scaffold. Other prior art shows a scaffold ladder adapter which will secure a standard ladder to a scaffold by grabbing the ladder below one of its rungs on one end and securing itself to the cross bars of the scaffold on the other. Other prior art shows a ladder safety apparatus that consists of a cable with hooks on the end. The cable is to be run through one of the rungs of the ladder and the hooks placed on the object to which the ladder is being secured. Still other prior art shows a safety device for ladders which consists of a body which surrounds one rung of the ladder and straps connected to either end of the body to secure the body to the object in which the ladder is being secured. However, a significant problem that exists in all of the prior art is that the scaffold, or object to which the ladder is being secured, cannot be raised or lowered without detaching the ladder from the scaffold or object. If the scaffold of the prior art was raised, the ladder would be lifted off of the ground. If the scaffold were lowered the ladder would hit the ground and prevent the scaffold from moving. The prior art does not provide a method of supporting a ladder against a scaffold while still having the freedom to raise and lower the scaffold without having to detach and reattach the ladder.

The present invention solves the aforementioned problem and employs a number of novel features that render it highly advantageous over the prior art. By securing the ladder support device to the scaffold only and not the ladder, and allowing the ladder to run freely inside of a "channel" provided by the device, it allows the scaffold to be raised and lowered without effecting the ladder and while still supporting the ladder against the scaffold itself.

SUMMARY OF THE INVENTION

An object of this invention is to provide a ladder support device which will allow a ladder to be supported against a scaffold and prevent it from falling away from the scaffold or to the sides.

A further object of this invention is to provide a ladder support device which will allow a ladder to be supported against a scaffold and allow the scaffold to be raised or lowered without having to detach the ladder from the scaffold.

In one embodiment of the invention, the ladder support device comprises a pair of base arms. The first end of the base arms has a means for securing the base arms to a scaffolding plank. There is a cross arm which is connected perpendicularly between the base arms such that the base arms are parallel. There is a cylinder connected axially across each base arm far enough from the first end of the base arms as to overhang the end of the scaffolding plank to which the invention is attached. There is a rod inserted through the center of the cylinders. Both ends of this rod have a means for retaining the rod in the cylinder. There is a swivel tube covering the rod between the base arms. There are swivel arms, long enough to overhang a standard ladder vertical support, connected asymptotically to the ends of each swivel tube. There are axis rods connected perpendicular to the swivel arms opposite the swivel tube and sleeves surrounding each axis rod. There are caps secured to each axis rod opposite the swivel arms. Finally, there is a means for biasing the swivel arms toward a position perpendicular to the base arms.

In a second embodiment of the invention, the ladder support device comprises a pair of base arms. The first end of the base arms has a means for securing the base arms to a scaffolding plank. There is a cross arm which is connected perpendicularly between the base arms such that the base arms are parallel and far apart enough to fit a standard ladder between them. There is a tube connected perpendicularly across the base arms far enough from the first end of the base arms to overhang the end of the scaffolding plank to which the invention is attached. There are axis rods connected perpendicular to the second end of each base arm far enough from the tube so as to overhang a standard ladder vertical support. These axis rods are long enough to overhang a standard ladder vertical support. Finally, there are pair of sleeves surrounding each axis rod and caps secured to each axis rod opposite the base arm to hold the sleeve in place.

Other objects, features and advantages of the invention will become more readily apparent upon reference to the following description when taken in conjunction with the accompanying drawings.

DESCRIPTION OF THE INVENTION

Figure 1:
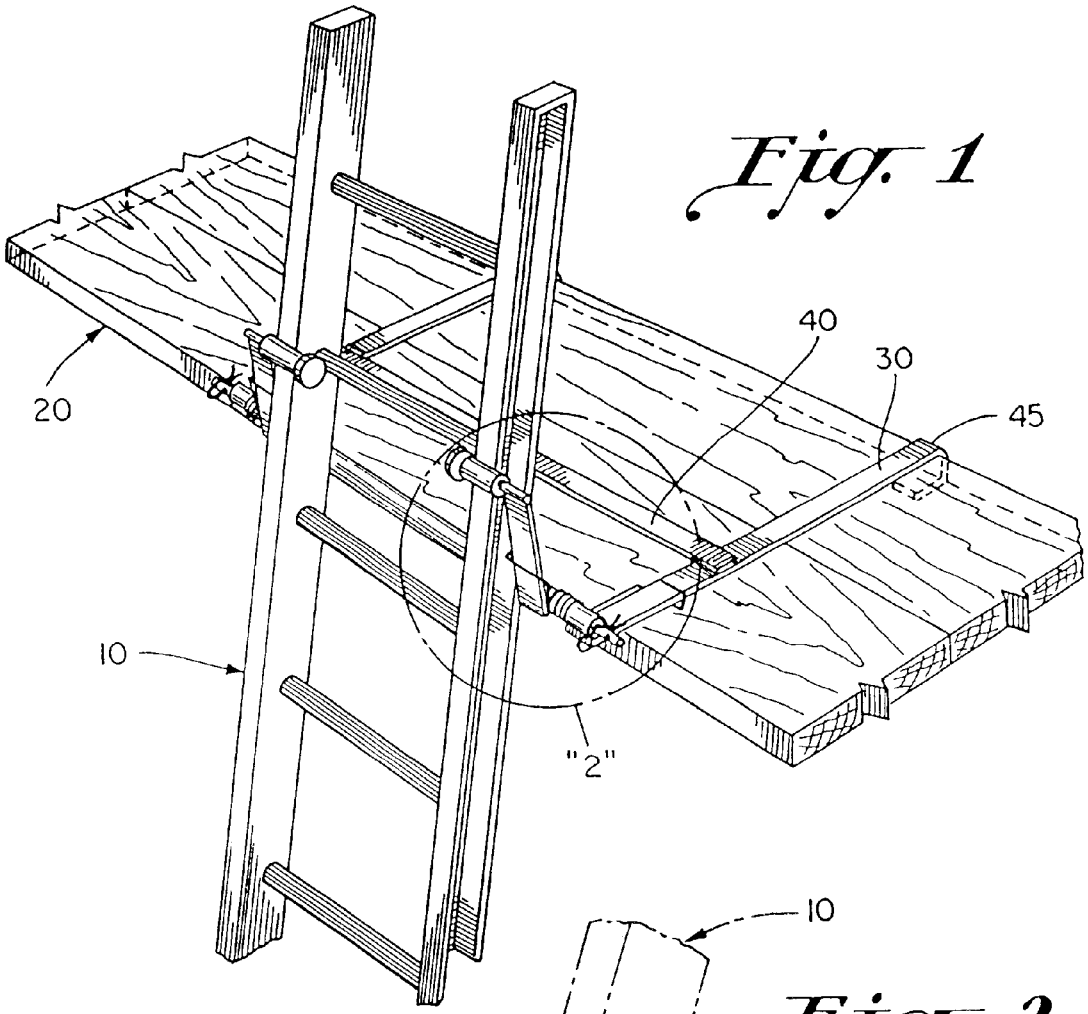
FIG. 1 is a perspective view of one embodiment of the invention with a standard ladder and scaffold planks.
Figure 2:
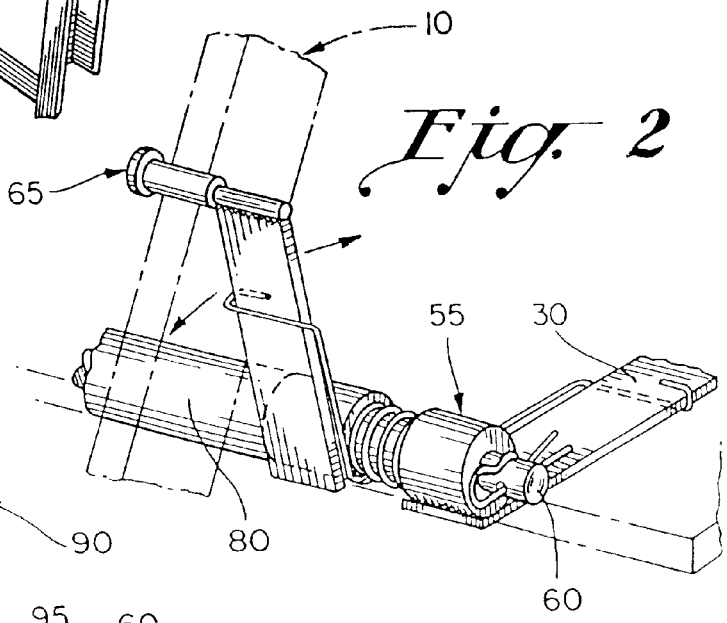
FIG. 2 is a perspective sectional view of one embodiment of the invention along the lines indicated "2" in FIG. 1.
Figure 3:
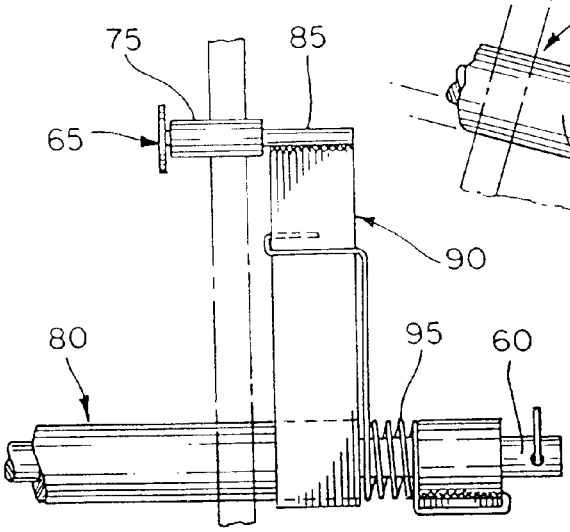
FIG. 3 is a front view of the section in FIG. 2.
Figure 4:
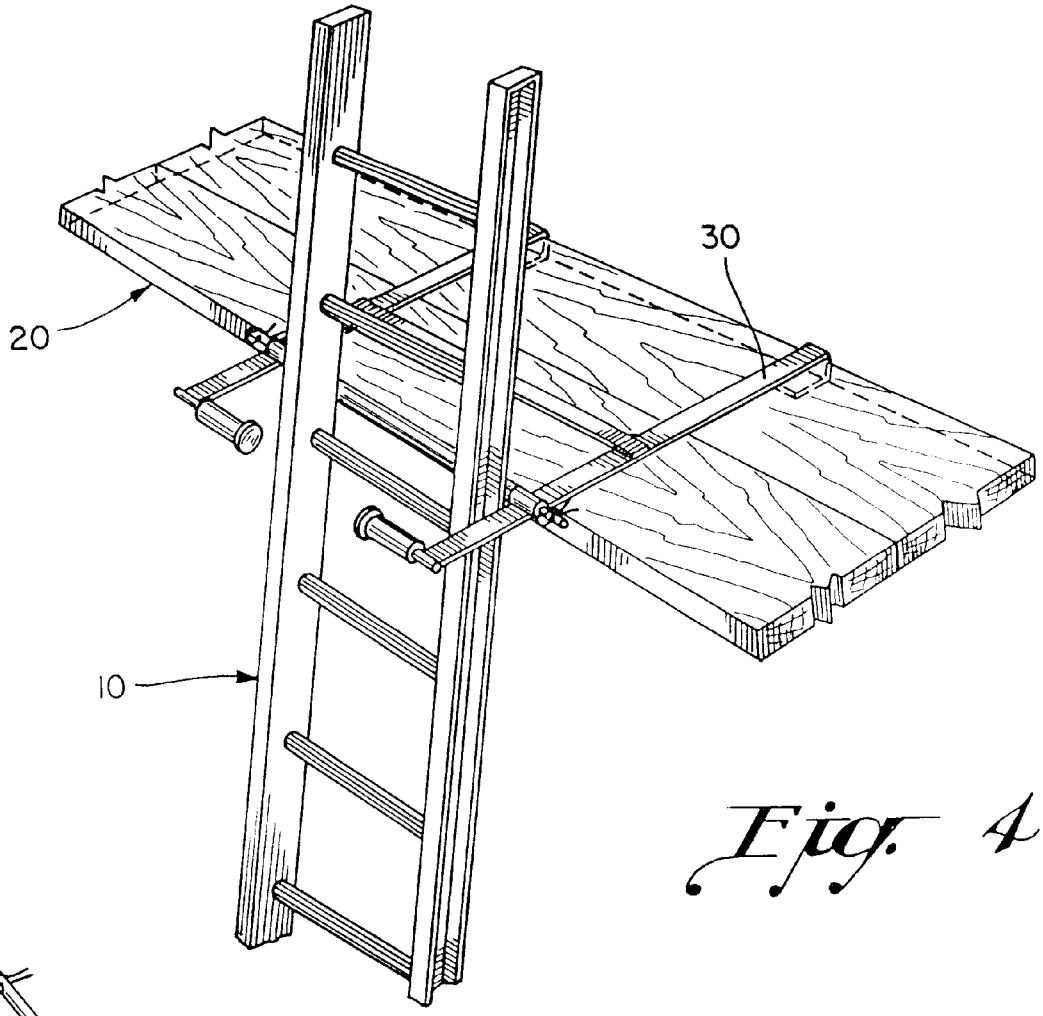
FIG. 4 is a perspective view of a second embodiment of the invention with a standard ladder and scaffold planks.
Figure 5:
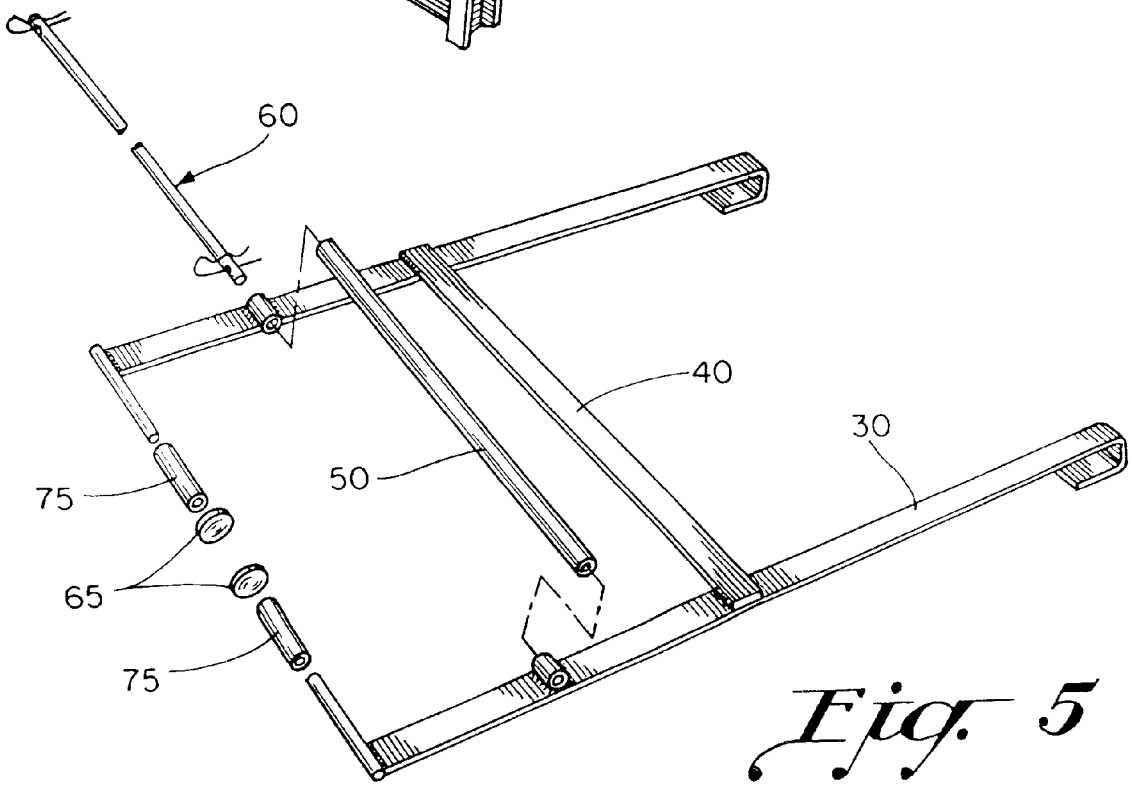
FIG. 5 is an exploded view of a second embodiment of the invention.
Figure 6:
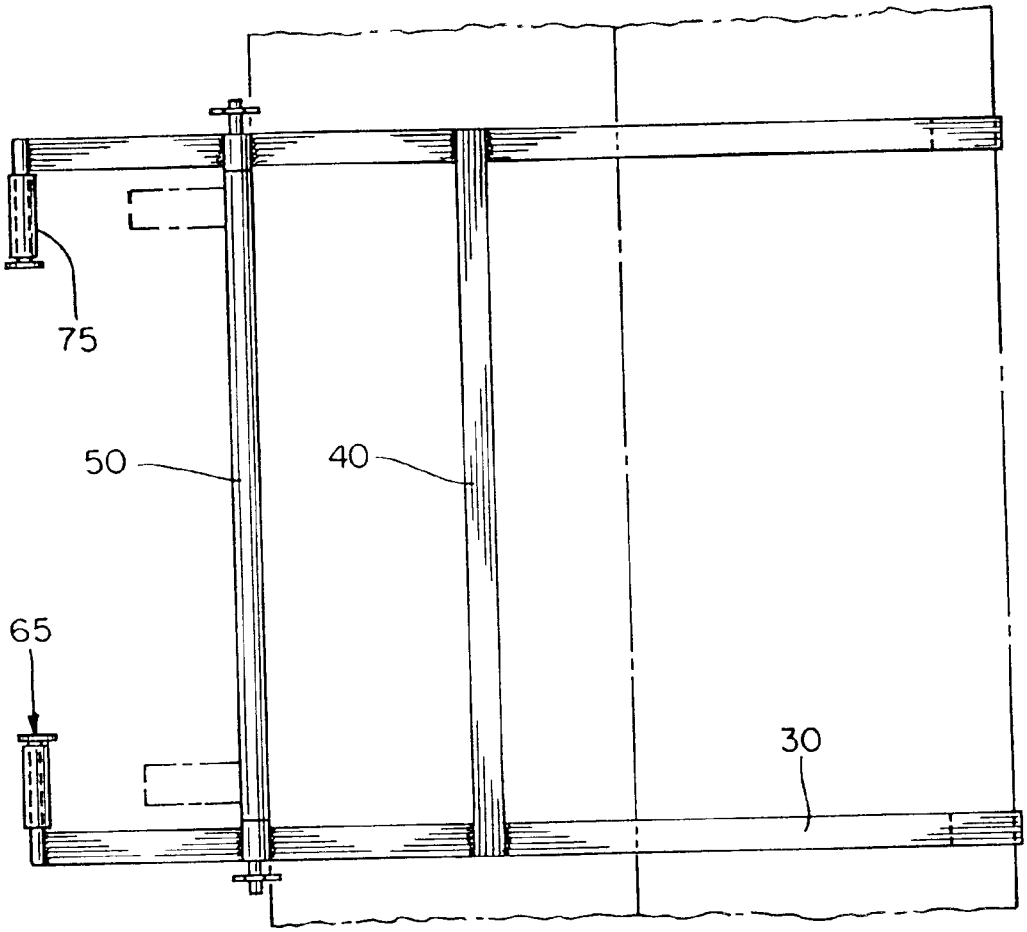
FIG. 6 is a top view of a second embodiment of the invention.
Figure 7:
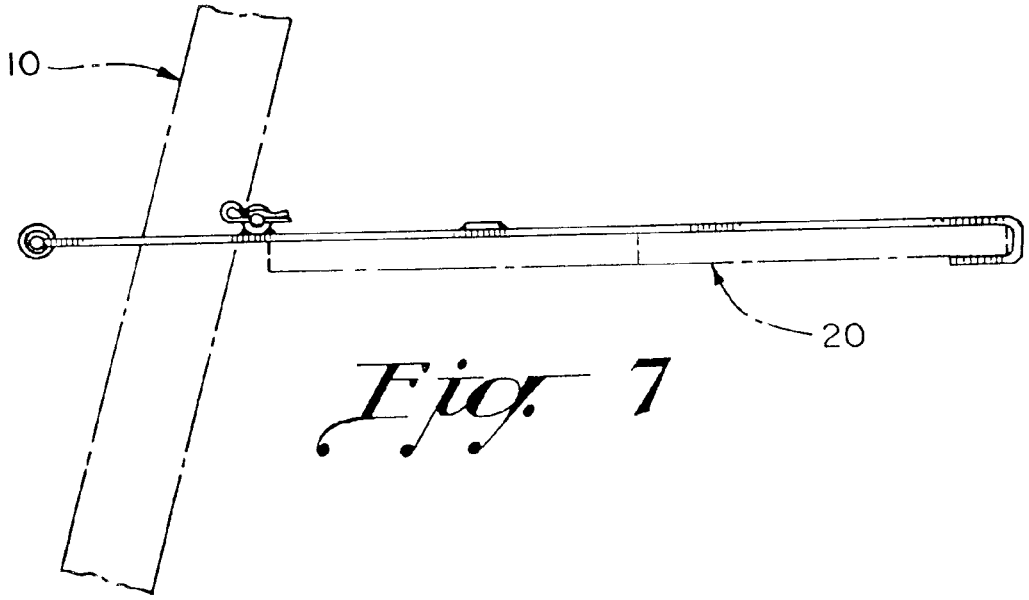
FIG. 7 is a side view of a second embodiment of the invention.

One embodiment of the invention, shown in FIGS. 1–3, provides a ladder support device which will support a ladder against a scaffold preventing the ladder from falling back from the scaffold and from falling to the sides. In addition, the ladder support device will allow the scaffold to be raised and lowered without having to detach the ladder from the scaffold and still have the ladder secured to the scaffold at all times. As shown in the figures, this particular embodiment of the invention contains a pair of base arms 30. One end of each base arm 30 has an attachment 45 or a means for securing the base arms 30 to a scaffold plank 20. This attachment 45 can be a "U" shape to hook over the end of the scaffold plank 20, a hole in the base arms 30 through which a nut and bolt are placed, or any means which would secure the base arms 30 to the scaffold plank 20. A cross arm 40 is connected perpendicularly between the base arms 30. This cross arm 40 secures the base arms 30 and assists in keeping the base arms 30 parallel. Cylinders 55 are then connected axially across the ends of each base arm 30, opposite the attachment 45, far enough from the attachment 45 so that they overhang the end of the scaffold 20. These cylinders 55 must protrude over the end of the scaffold 20 as along their axis' will be where the ladder 10 will rest. There is a rod 60 which is inserted through the center of the cylinders 55. At each end of this rod 60 is a means for retaining the rod 60 in the cylinders 55. This rod 60 also has a swivel tube 80 surrounding it in the area between the cylinders 55. This swivel tube 80 provides the area in which the ladder 10 will rest and provides a rolling motion which allows the ladder 10 to move smoothly when the scaffold 20 is raised or lowered. There are swivel arms 90 which are connected asymptotically to each end of the swivel tube 80. These swivel arms 90 are long enough that when they are extended in line with the base arms 30 they will at least overhang the ladder's 10 vertical supports. They must also be far enough apart so that a ladder 10 can fit in between the two swivel arms 90. This prevents the ladder 10 from falling to either side. The swivel arms 90 have axis rods 85 connected perpendicularly at the ends opposite the connection to the swivel tube 80. These axis rods 85 protrude inwardly at least far enough so that they will overhang the ladder's 10 vertical supports. The tube and swivel arms form a channel sized for receiving the ladder therethrough. The rods keep the ladder 10 from falling away from the scaffold 20 or swivel tube 80. Each axis rod 85 has a sleeve 75 surrounding it. The sleeve 75 provides a rolling motion which allows the ladder 10 to move smoothly when the axis rods 85 are pushed against the ladder 10. In addition, there are caps 65 on the end of each axis rod 85 which secure the sleeves 75 to the axis rods. Finally, there is a bias 95 or means for biasing the swivel arms 90 in a position perpendicular to the base arms 30. This bias can be by means of a torsion spring surrounding the rod which pushes against the swivel arms 90 and base arms 30, a standard spring which would pull the swivel arms 90 towards the base arms 30, or any means to bias the swivel arms 90 towards a position perpendicular to the base arms 30. This biasing of the swivel arms makes the axis rods 85 push against the ladder 10 and secure it between the axis rods 85 and the swivel tube 80. Accordingly, the rods of the swivel arms are biased in pressing engagement against a front side of the ladder with the tube in pressing engagement against a back side of the ladder.

A second embodiment of the invention, shown in FIGS. 4–7, also provides a ladder support device which will support a ladder against a scaffold device preventing the ladder from falling back from the scaffold and from falling to the sides. In addition, this embodiment will also allow the scaffold to be raised and lowered without having to disconnect the ladder from the scaffold and still have the ladder secured to the scaffold at all times. As shown in the figures, this particular embodiment of the invention contains a pair of base arms 30. One end of each base arm 30 has an attachment 45 or a means for securing the base arms 30 to a scaffold plank 20. This attachment 45 can be a "U" shape to hook over the end of the scaffold plank 20, a hole in the base arms 30 through which a nut and bolt are placed, or any means which would secure the base arms 30 to the scaffold plank 20. A cross arm 40 is connected perpendicularly between the base arms 30. This cross arm 40 secures the base arms 30, keeps them far enough apart so that a ladder 10 can fit between them, and assists in keeping the base arms 30 parallel. There is a tube 50 which is connected perpendicular and between the base arms 30. This tube 50 is connected opposite the attachment 45 and far enough from the attachment 45 so that it overhangs the end of the scaffold 20. This tube 50 must protrude over the end of the scaffold 20 as this is where the ladder 10 will rest. There are axis rods 85 connected to the base arms 30 perpendicularly at the ends opposite the attachment 45. These axis rods 85 must be far enough from the tube 50 so that they overhang the ladder's 10 vertical supports. In addition, these axis rods 85 protrude inwardly at least far enough so that they will overhang the ladder's 10 vertical supports. These then keep the ladder 10 from falling away from the scaffold 20 or tube 50. Each axis rod 85 has a sleeve 75 surrounding it. The sleeve 75 provides a rolling motion which allows the ladder 10 to move smoothly if the ladder 10 is pushed against the axis rods 85. In addition, there are caps 65 on the end of each axis rod 85 which secure the sleeves 75 to the axis rods. As clearly shown in both FIGS. 1 and 4, the pair of base arms 30 substantially lie in a common plane with one another and the axis rods generally extend through a common axis relative to one another and are spaced apart from one another forming a gap therebetween. As previously described, the axis rods are far enough apart so that a ladder 10 can fit in between the two swivel arms. As further shown in FIGS. 1 and 4, the previously described channel for receiving the ladder formed by rod and swivel arms is C-shaped.

The foregoing descriptions of the preferred embodiments of the invention have been presented for purposes of illustration and description, and are not intended to be exhaustive or to limit the invention to the precise forms disclosed. The descriptions were selected to best explain the principles of the invention and their practical application to enable others skilled in the art to best utilize the invention in various embodiments and various modifications as are suited to the particular use contemplated. It is intended that the scope of the invention not be limited by the specification, but be defined by the claims set forth below.

I claim:

1. A ladder support device, comprising:

a. a pair of base arms having a first and second end;

b. the first end of each base arm having a means for securing to a scaffolding plank;

c. a cross arm connected perpendicularly between the base arms such that the base arms are parallel;

d. a cylinder connected axially across each base arm far enough from the first end of the base arms as to overhang the scaffold plank;

e. a rod inserted through the center of the cylinders having a means for retaining the rod in the cylinder;

f. a swivel tube covering the rod between the base arms;

g. a pair of swivel arms, long enough to overhang a standard ladder vertical support, connected radially to opposite ends of the swivel tube;

h. a pair of axis rods connected perpendicularly to the swivel arms opposite the swivel tube; and i. means for biasing the swivel arms in a position perpendicular to the base arms.

2. A ladder support device, as recited in claim 1, further comprising:

a. a first and second sleeve surrounding each axis rod; and b. a first and second cap secured to each axis rod opposite the swivel arm to hold each sleeve in place.

3. A ladder support device for use in combination with a ladder and a scaffolding plank, the device comprising:

a pair of base arms, a first end of each of said base arms operatively connected to a rod extending therebetween, the pair of base arms substantially lying in common plane with one another, a second end of each of said based arms being hook shaped and adapted to hook the pair of base arms with the scaffolding plank;

a pair of swivel arms connected to respective first ends of the base arms, the swivel arms extending outwardly from the base arms, each of said swivel arms has an axis rod connected perpendicularly to an outer end of the respective swivel arm, the axis rods generally extending through a common axis relative to one another and being spaced apart from one another forming a gap therebetween, the rod and swivel arms forming a C-shaped channel sized for receiving the ladder therethrough.

4. The ladder support device of claim 3, wherein the rod has a sleeve rotatably mounted thereon.

5. The ladder support device of claim 3, wherein the axis rod of each swivel arm has a sleeve rotatably mounted thereon.

6. The ladder support device of claim 3, wherein the pair of swivel arms are hingedly connected to respective first ends of the base arms and include means for biasing the swivel arms to a position perpendicular to the base arms.

7. The ladder support device of claim 4, wherein the rods of the swivel arms are adapted to be biased in pressing engagement against a front side of a ladder with the tube in pressing engagement against a back side of the ladder.

8. The ladder support device of claim 4, wherein the base arms extend parallel to one another and a cross arm is connected perpendicularly therebetween the base arms.

9. A ladder support device for use in combination with a ladder and a scaffolding plank, the device comprising:

a pair of base arms adapted for securement with the scaffolding plank, a first end of each of said base arms operatively connected to a rod extending therebetween;

a pair of swivel arms connected to respective first ends of the base arms, the swivel arms extending outwardly from the base arms, each of said swivel arms has an axis rod connected perpendicularly to an outer end of the respective swivel arm, the rod and swivel arms forming a channel sized for receiving the ladder therethrough, the pair of swivel arms being hingedly connected to respective first ends of the base arms and include means for biasing the swivel arms to a position perpendicular to the base arms.

10. The ladder support device of claim 9, wherein the rod has a sleeve rotatably mounted thereon.

11. The ladder support device of claim 10, wherein the axis rod of each swivel arm has a sleeve rotatably mounted thereon.

12. The ladder support device of claim 9, wherein each of the base arms has a hook shaped second end.

13. The ladder support device of claim 12, wherein the base arms extend parallel to one another and a cross arm is connected perpendicularly therebetween the base arms.

* * * * *